US009931530B2

(12) United States Patent
Bonner

(10) Patent No.: US 9,931,530 B2
(45) Date of Patent: Apr. 3, 2018

(54) STAND UP PADDLEBOARD

(71) Applicant: Fitness OnBoard, Pensacola Beach, FL (US)

(72) Inventor: Cindi Bear Bonner, Pensacola, FL (US)

(73) Assignee: Fitness OnBoard, Pensacola Beach, FL (US)

( * ) Notice: Subject to any disclaimer, the term of this patent is extended or adjusted under 35 U.S.C. 154(b) by 637 days.

(21) Appl. No.: 14/231,787

(22) Filed: Apr. 1, 2014

(65) Prior Publication Data

US 2014/0213127 A1 Jul. 31, 2014

Related U.S. Application Data

(63) Continuation of application No. PCT/US2013/036399, filed on Apr. 12, 2013.

(60) Provisional application No. 61/623,811, filed on Apr. 13, 2012.

(51) Int. Cl.

| | |
|---|---|
| ***B63B 35/81*** | (2006.01) |
| ***A63C 5/03*** | (2006.01) |
| ***A63B 21/04*** | (2006.01) |
| ***B63B 35/79*** | (2006.01) |
| *B63B 21/22* | (2006.01) |

(52) U.S. Cl.

CPC ..... *A63B 21/0442* (2013.01); *B63B 35/79* (2013.01); *B63B 35/7909* (2013.01); *B63B 35/7933* (2013.01); *B63B 21/22* (2013.01)

(58) Field of Classification Search

CPC . B63B 35/79; B63B 35/7909; B63B 35/7933; B63B 21/22

USPC .... 441/65, 74, 75, 76, 79; 114/39.12, 39.14; 482/1, 51, 52, 121, 123

See application file for complete search history.

(56) References Cited

U.S. PATENT DOCUMENTS

| | | | | |
|---|---|---|---|---|
| 1,615,568 | A * | 1/1927 | Carroll | 440/34 |
| 3,145,400 | A * | 8/1964 | Yoakum | 441/65 |
| 3,237,222 | A * | 3/1966 | Frost | 441/65 |
| 4,986,784 | A * | 1/1991 | French | 441/65 |
| 5,807,214 | A * | 9/1998 | Riazi | 482/129 |
| 6,042,439 | A * | 3/2000 | Parten | 441/65 |
| 6,692,415 | B1 * | 2/2004 | Winston | 482/126 |
| 7,025,644 | B2 * | 4/2006 | Geier et al. | 441/74 |
| 7,371,141 | B1 * | 5/2008 | Lin | 441/75 |
| 7,481,689 | B2 * | 1/2009 | Wiginton | 441/75 |
| 7,591,763 | B1 * | 9/2009 | Fucci | 482/52 |
| 8,206,266 | B2 * | 6/2012 | Hall | 482/1 |

(Continued)

FOREIGN PATENT DOCUMENTS

| | | |
|---|---|---|
| JP | 09-076990 | 3/1997 |

OTHER PUBLICATIONS

Thera-Band GmbH, Thera-Band Resistance Band & Tubing Instruction Manual vol. 4, Jan. 2006, The Hygenic Corporation.*

(Continued)

*Primary Examiner* — Daniel V Venne

(74) *Attorney, Agent, or Firm* — Meunier Carlin & Curfman LLC

(57) ABSTRACT

Provided are stand up paddleboards (SUPs) and methods for exercising using a stand up paddleboard (SUP). The described SUPs optionally expand the fitness experience of a paddleboard to other fitness activities, including Yoga, Pilates, strength training, Boot Camp, and personal training tailored to the unique needs of the participant.

26 Claims, 14 Drawing Sheets

(56) References Cited

U.S. PATENT DOCUMENTS

| | | | | |
|---|---|---|---|---|
| 8,403,818 | B1 * | 3/2013 | Wilkinson et al. | 482/121 |
| 8,590,478 | B2 * | 11/2013 | Lipman | 114/363 |
| 8,702,570 | B1 * | 4/2014 | DelPriore et al. | 482/51 |
| 8,721,507 | B2 * | 5/2014 | Blancher | 482/121 |
| 2002/0160891 | A1 * | 10/2002 | Gallagher | 482/123 |
| 2008/0108260 | A1 | 5/2008 | Wiginton | |
| 2010/0273372 | A1 | 10/2010 | Parsia | |
| 2011/0251033 | A1 | 10/2011 | Blancher | |
| 2012/0122357 | A1 * | 5/2012 | Eckert et al. | 441/79 |

OTHER PUBLICATIONS

APTA, Thera-Band Resistance Band & Tubing Instruction Manual Rev. 1, May 2012, The Hygenic Corporation, Table p. 11.*

PCT/US/2013/036399 International Search Report and Written Opinion. International filing date Apr. 12, 2013.

* cited by examiner

STAND UP PADDLEBOARD

CROSS-REFERENCE TO RELATED APPLICATIONS

This application is a continuation of International Application No. PCT/US2013/036399, filed Apr. 12, 2013, which claims priority to U.S. Provisional Application No. 61/623,811, filed Apr. 13, 2012, both of which are hereby incorporated by reference in their entirety.

BACKGROUND

Stand up paddleboarding is a fast-growing sport that is a fun, easy way to play on the water. With minimal equipment, you can paddle anything from ocean surf to lakes and rivers. The paddling involved in stand up paddleboarding offers a full body workout and is becoming a favorite cross-training and exercise activity.

SUMMARY

Provided are stand up paddleboards (SUPs) and methods for exercising using a stand up paddleboard (SUP).

An example SUP comprises a floating body having a long midline axis, a bow end, a stern end, a top surface and a bottom surface. The top region optionally comprises a slip resistant material, which can optionally extend from the bow to the stern. The SUP further comprises a deck region located on the top surface on which a user stands to operate the SUP. The deck region alone can optionally comprise the slip resistant material.

The SUP also includes at least one attachment region located on the top surface. At least one attachment member is located within each attachment region. The attachment member is connectable to an elastic exercise apparatus. For example, the elastic exercise apparatus optionally comprises one or more exercise tubing. A first end of the exercise tubing is optionally connected at the attachment member. A second end of the exercise tubing is optionally attached to, or integral with, a handle for grasping by the user of the SUP.

Optionally, at least one attachment region is located between the deck region and the stern end of the body. For example, at least two attachment regions are optionally located between the deck region and the stern end of the body. In another example, three attachment regions are optionally located between the deck and the stern end of the body.

Optionally, at least one attachment region is located between the deck region and the bow end of the body. For example, at least two attachment regions are located between the deck region and the bow end of the body. Optionally, two attachment regions are located between the deck region and the bow end of the body. In another example, three attachment regions are optionally located between the deck and the bow end of the body.

Optionally, at least two attachment regions are located between the deck region and the bow end of the body, and at least two attachment regions are located between the deck region and the stern end of the body. In one example, at least three attachment regions are located between the deck region and the bow end of the body, and at least three attachment regions are located between the deck region and the stern end of the body.

At least one attachment member is optionally located along the long midline axis of the body. For example, at least two attachment members are along the long midline axis of the body. In another example, at least three attachment members are along the long midline axis of the body.

At least one attachment member is optionally spaced from the long midline axis of the body. For example, one, or a plurality of, such as two, three, four, or more attachment members are optionally spaced from the long midline axis of the body. Optionally, a pair of attachment members is located in the same attachment region and each attachment member of the pair is spaced from the long midline axis of the board.

Optionally, at least one attachment region is located within the deck region. For example, at least four attachment regions are located within the deck region. Optionally, the one or more attachment members within the deck region are located along the long midline axis of the body. Optionally, one or more attachment members within the deck region are spaced from the long midline axis of the body.

Optionally, at least one attachment member is located along the long midline axis of the body. For example, two, three, or four attachment members can be located along the long midline axis of the body, and can be in the bow, stern, or deck region. Optionally, at least one attachment member is located along the long midline axis of the body between the bow end and the deck region and at least one pair of attachment members is located between the bow end and the deck region with each member of the pair being spaced from the long midline axis of the body. Optionally, at least one additional attachment member located along the long midline axis of the body within the deck region. Optionally, the SUP further comprises at least one pair of attachment members, each member of the pair being spaced from the long midline axis of the body in the deck region of the body.

Optionally, at least one attachment member is located along the long midline axis of the body between the stern end and the deck region and at least one pair of attachment members is located between the stern end and the deck region. Each member of the pair is optionally spaced from the long midline axis of the body. Optionally, at least one additional attachment member is located along the long midline axis of the body within the deck region. Optionally, the SUP further comprises at least one pair of attachment members, each member of the pair being spaced from the long midline axis of the body and wherein the pair is located with the deck region of the body.

The attachment members optionally comprise a cavity recessed into the body of the SUP, wherein the cavity has an opening flush with the top surface and an attachment portion located within the cavity below the opening. The attachment portion optionally comprises a bar spanning the inner diameter of the cavity, at a level below the opening plane of the cavity and above the bottom of the cavity. The attachment portion is optionally connectable to a carabineer type connector. The attachment portion of the attachment member is resistant to being removed from the SUP.

The example SUP optionally further comprises a channel located within the body. The channel optionally has a first channel opening communicating with the top surface of the body and a second channel opening also communicating with the top surface of the body. The second opening is spaced from the first opening and more proximate the bow end than the first opening. The channel is optionally configured to house a line that is slideable through the channel and through each channel opening. An end of the line optionally extends out of the first channel opening and an anchor is optionally connectable to the end of the line that extends out of the first channel opening. The line is slideable through the channel to allow the anchor to descend away from the body when the body is floating on water.

The top and bottom surfaces of the SUP are optionally integral to define an open interior space. The open interior space optionally houses one or more flotation slats. Each slat optionally has a long axis positioned at a substantially right angle to the long midline axis of the body. Each slat is optionally spaced from each adjacent slat by a predetermined distance.

The spacing between slats is optionally less between the slats positioned in the body beneath the deck region of the top surface than the spacing between the slats positioned in the body beneath the top surface and between the deck region and the bow end. The spacing between slats is optionally less between the slats positioned in the body beneath the deck region of the top surface than the spacing between the slats positioned in the body beneath the top surface and between the deck region and the stern end.

Each attachment member optionally comprises a cavity recessed into the body. The cavity of each attachment member has an opening flush with the top surface. Each attachment member further comprises an attachment portion located within the cavity below the opening. The cavity is optionally recessed between two adjacent slats. Each attachment member is optionally sealed to the body to prevent ingress of water into an open area of the body when the SUP is used in the water.

The top surface of the SUP is optionally configured to flex when a user stands on the deck region to operate the SUP. For example, the top region is optionally configured to flex into contact with one or more of the flotation slats when the user stands of the deck region to operate the SUP.

The example SUP optionally further comprises a storage container recessed into the body. The storage container optionally has an opening flush with the top surface and a lid that is sealable about the opening to prevent, or reduce, ingress of water into the storage container when the SUP is operated in water.

Also provided is an example SUP comprising a body having a top surface, a bottom surface, a bow and a stern, wherein the top and bottom surfaces are integral to define an open interior space. Optionally, the top and the bottom surfaces are integral to form a rounded rail 123 profile as shown in FIGS. 6A and 6B.

The open interior space optionally houses one or more flotation slats. Each slat optionally has a long axis positioned at a substantially right angle to the long midline axis of the body. Optionally, each slat is spaced from each adjacent slat by a predetermined distance. Optionally, the top surface further comprises a deck region. Optionally, the spacing between slats is less between the slats positioned in the body beneath the deck region of the top surface than the spacing between the slats positioned in the body beneath the top surface and between the deck region and the bow end. Optionally, the spacing between slats is less between the slats positioned in the body beneath the deck region of the top surface than the spacing between the slats positioned in the body beneath the top surface and between the deck region and the stern end.

The example SUP optionally further comprises at least one attachment region located on the top surface. At least one attachment member is located within each attachment region and the attachment member is operably connectable with an elastic exercise apparatus. Each attachment member optionally comprises a cavity recessed into the body. The cavity optionally has an opening flush with the top surface of the body. The attachment member optionally further comprises an attachment portion located within the cavity below the opening. Each cavity is recessed into the body between two adjacent slats. The attachment member is optionally sealed to the body to prevent ingress of water into the open space of the body when the SUP is used in the water.

The top surface of the SUP is optionally configured to flex when a user stands on the deck region to operate the SUP. For example, the top region is optionally configured to flex into contact with one or more of the flotation slats when the user stands of the deck region to operate the SUP.

The example SUP optionally further comprises a storage container recessed into the body. The storage container optionally has an opening flush with the top surface and a lid that is sealable about the opening to prevent, or reduce, ingress of water into the storage container with the SUP is operated in water. Optionally, the storage container is recessed into the body between two adjacent slats.

Further provided is a SUP comprising a floating body having a top surface and at least one hollow space defined by the body. The example SUP further comprises a recessed cavity with an opening flush with the top surface, wherein the cavity is recessed into the hollow space. Optionally, the cavity is an attachment member that is operably connectable with an elastic exercise apparatus. Optionally, the cavity is a dry storage container wherein the opening is sealable to restrict water ingress into the container.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Provided are stand up paddleboards (SUPs) and methods for exercising using a stand up paddleboard (SUP). The described SUPs optionally expand the fitness experience of a paddleboard to other fitness activities, including Yoga, Pilates, strength training, Boot Camp, and personal training tailored to the unique needs of the participant. The described SUPs can also be used as a traditional SUP would be used. Thus, the described SUPs can be used to expand the fitness options for participants using the boards as well as for traditional paddleboard uses.

The described paddleboards also offer expanded versatility and functionality given their lighter weight, anchoring capability, and features such as dry storage. The participant, or user of the SUPs, also has the ability to connect fitness equipment to the board using the described integral attaching system. These features allow users to optionally perform strength training exercises while on the SUP.

The described paddleboards optionally includes between one and eight or more attachment areas throughout the length of the board allowing connecting points for exercise tubing with handles. This feature allows strength training exercises to be performed while on the board. The attachment locations are strategically placed in specific areas to allow strength training exercises to be performed for every major muscle group (e.g. chest, back, shoulders, biceps, triceps, legs, and gluteus maximus).

Figure 1A:
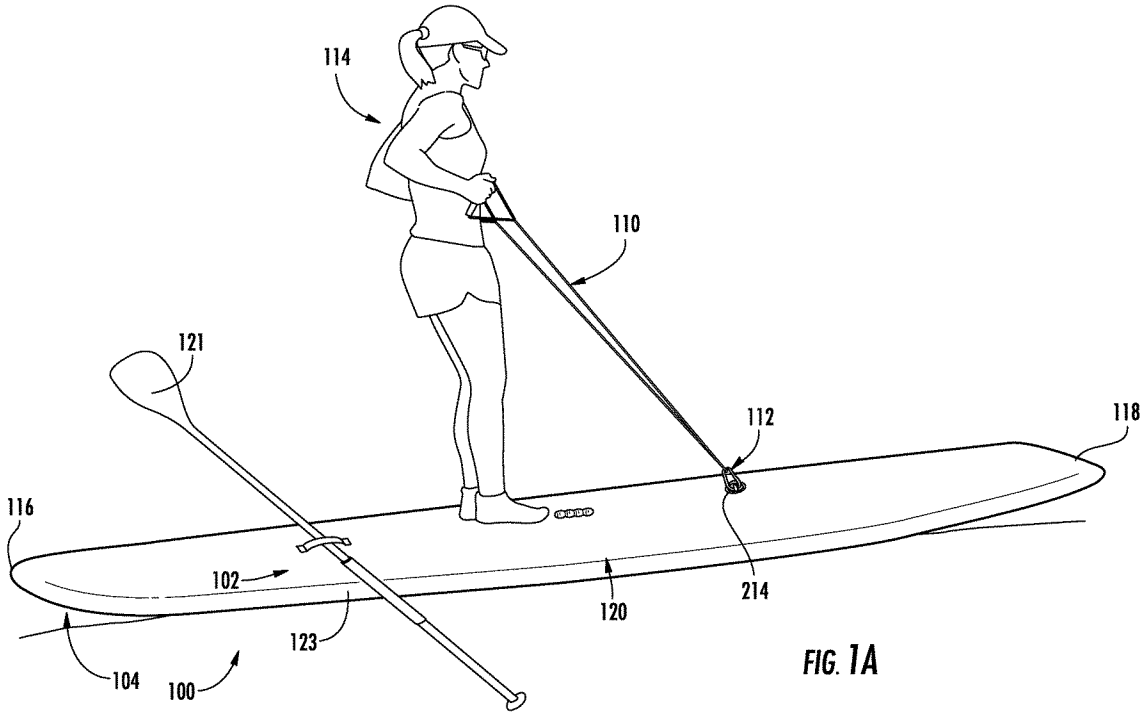
FIG. 1A is a schematic diagram illustrating an example SUP and operator exercising on the SUP.

FIG. 1A is a schematic illustration of an example SUP and an operator 114 of the SUP. The example SUP comprises a body 100. The body 100 has a top surface 102 and a bottom surface 104. The top surface is designed for the operator to stand, sit or lay on to paddle the SUP using the paddle 121 or to participate in one or more exercises. The bottom surface 104 contacts the water on which the body floats.

The body has sufficient buoyancy to stay afloat while the operator is positioned on the top surface. The body also has a bow end 116 and a stern end 118. The operator optionally stands, sits or is recumbent between the stern and the bow ends on a deck region 120. Optionally, the operator stands near the middle of the SUP in its longest dimension. The top surface 102 and bottom surface 104 are optionally integral with each other at the rail portion 123 of the SUP.

One or more attachment regions are located on the top surface 102 of the board. An attachment region is an area of the board that comprises at least one attachment member. Thus, each attachment region includes one or more attachment members, for example 214. Although some features of the attachment member are described in regard to the attachment member 214, other attachment members optionally share these same features. Optionally, at least one attachment member is recessed into the top surface 102 within the attachment region.

An attachment member optionally includes a cavity or cup recessed into the body of the SUP and an attachment portion located in the cavity or cup. The cavity or cup is resistant to being pulled or removed from the body of the SUP. Therefore, a large amount of pulling or tugging can be done to the attachment portion of the attachment member, without the attachment member being released from the SUP. For example, Table 1 provides a list of various pressures that can be applied to exercise tubing, and the resistance that occurs with the progressively stronger tubing. This shows that the attachment member is embedded into the SUP in such a way that it is not removed, even with a user pulling with the force given below sufficient to elongate exercise tubing.

TABLE 1

| Band/ Tubing Color | Increase from Preceding Color at 100% Elongation | Resistance in Pounds at: 100% Elongation | Resistance in Pounds at: 200% Elongation | Resistance in Kilograms at: 100% Elongation | Resistance in Kilograms at: 200% Elongation |
|---|---|---|---|---|---|
| Tan | — | 2.4 | 3.4 | 1.1 | 1.5 |
| Yellow | 25% | 3.0 | 4.3 | 1.3 | 2.0 |
| Red | 25% | 3.7 | 5.5 | 1.7 | 2.5 |
| Green | 25% | 4.6 | 6.7 | 2.1 | 3.0 |
| Blue | 25% | 5.8 | 8.6 | 2.6 | 3.9 |
| Black | 25% | 7.3 | 10.2 | 3.3 | 4.6 |
| Silver | 40% | 10.2 | 15.3 | 4.6 | 6.9 |
| Gold | 40% | 14.2 | 21.3 | 6.5 | 9.5 |

Optionally, the SUP can be constructed using a foam core base. In one example, 1 pound (lb) EPS foam core base is used. High density foam inserts can then be inserted into the foam base, using, for example, an epoxy resin. A veneer, such as a wood or bamboo laminate, can then be applied to the surface of the SUP. Optionally, it can be applied to the entire top surface of the SUP.

Optionally, holes can be drilled which are used for inserting the attachment members. These can optionally be attached using epoxy into the high density foam. A gloss laminate can then be applied to the cup (attachment member) area. In one example, a receiving portion of the attachment member can be formed by cutting out a center of the cup, thereby allowing for the attachment of an object, such as elastic exercise tubing. The SUP surface can be coated with a substance such as a fiber glass on top of the veneer.

The attachment member 214 is optionally connected by the attachment portion to an exercise device, such as exercise tubing, which is also known as resistance tubing. Exercise tubing is well known in the art and is frequently used in a variety of fitness protocols. For example, an end of the exercise tubing 110 can be connected to the attachment member 214 with the use of a carabineer-type attachment mechanism 112. The second end of the exercise tubing 110 can be attached to, or used as, a handle, which may be grasped by the operator 114 while the operator is standing, sitting or laying down on the top surface 102 of the body 100.

Figure 1B:
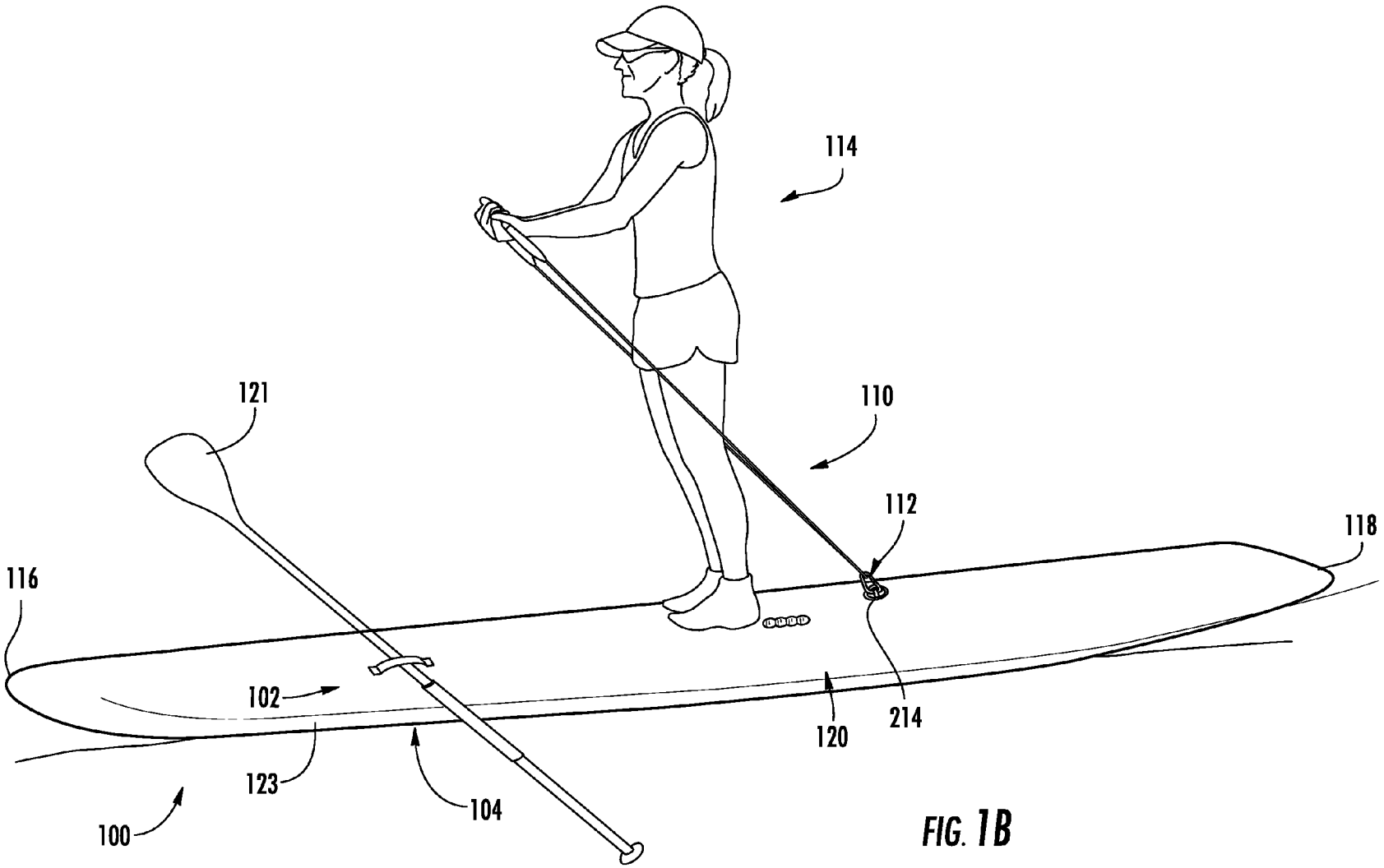
FIG. 1B is a schematic diagram illustrating an example SUP and operator exercising on the SUP.

The operator can then pull against the exercise tubing to exercise one or more muscle or muscle groups. Optionally, as shown in FIGS. 1A and 1B, the operator stands on the device and exercises one or more muscle by stretching the exercise tubing which offers resistance to the muscle or group of muscles stretching the tubing. FIG. 1B shows that the operator can optionally change their position on the top surface. For example, the operator optionally changes their position on the top surface to change the muscle or groups of muscles to be exercised. For example, the operator in FIG. 1A exercising primarily the shoulders and back, while the operator in FIG. 1B is exercising primarily the biceps. The operator can also sit, kneel, or lay prone on the stomach or on the back to perform additional exercise maneuvers as desired. FIGS. 1A and 1B also illustrate a slot, optionally positioned in the deck region, for grasping the board to carry it or to move it. Optionally, the slot is positioned about sixty-six inches from the bow of the board and about 12 inches from the right side of the board.

Figure 1C:
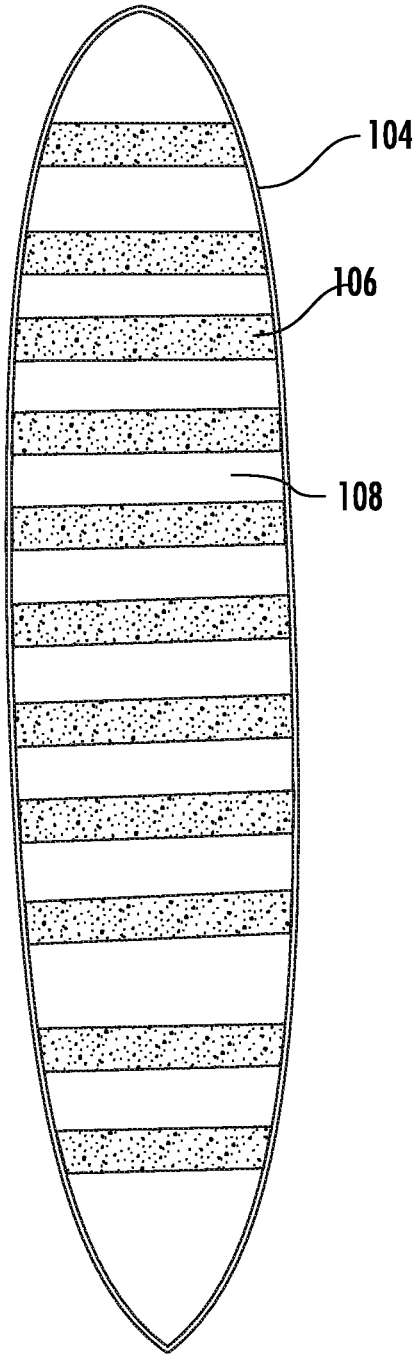
FIG. 1C is a schematic diagram illustrating an example SUP bisected into top and bottom portions, with the bottom portion illustrated.

FIG. 1C is a schematic illustration of an example SUP body bisected in a plane perpendicular to its longitudinal axis. The bisected illustration shows the bottom surface 104. The body defines an open area 108. This open, or hollow body, construction accommodates multiple attachments such as those described herein that expand the board's functionality. Although FIG. 1C illustrates a hollow body design, other example SUP bodies are substantially filled with foam or other buoyant material as is traditional in the surfboard arts.

In embodiments with an open area, the open area 108 is optionally crossed by a plurality of flotation slats 106. Optionally, the slats 106 cross the open area 108 at right angles to the longitudinal axis of the body. One or more slats 106 are optionally made of polypropylene foam. The slats optionally provide buoyancy to the body. In addition, the slats optionally provide rigidity to the body. In some examples SUPs, the top and/or the bottom surfaces are flexible. For example, the top and/or bottom surfaces are optionally fiberglass or polypropylene laminate that allows flexing.

The slats are integral with the inner surface of the body and provide structure and rigidity to the SUP beyond that which is provided by the top and bottom surfaces alone. In example SUPs where the top surface is flexible, it provides a softer and more cushioned platform for the operator 114. This softer platform may be especially desirable where the operator is participating in an exercise routine with extended periods of standing on the top surface.

By offering the added stability, the slats help maintain a SUP of desired rigidity while allowing for a flexible top that is more comfortable for the operator. In addition, each slat is spaced from its adjacent slat. Because the body defines a substantially open space 108, the slats provide structure to the body, without filling the entire body with structure. This can be contrasted with SUPs known in the art and other surfboards which are filled with foam or other buoyant materials. This configuration has other advantages as well. For example, the attachment member described in regard to FIGS. 1A and 1B includes a cup or cavity that extends below the top surface level into the open space of the body. The attachment members are optionally positioned above the spaces between the slats and the body can remain water-tight while accepting the extending protrusion into the open space of the body. The attachment members can also be used in boards which are filled with foam or other buoyant materials. In this regard, the attachment members optionally include a cup or cavity that extends below the top surface level into the foam or buoyant material.

Figure 1D:
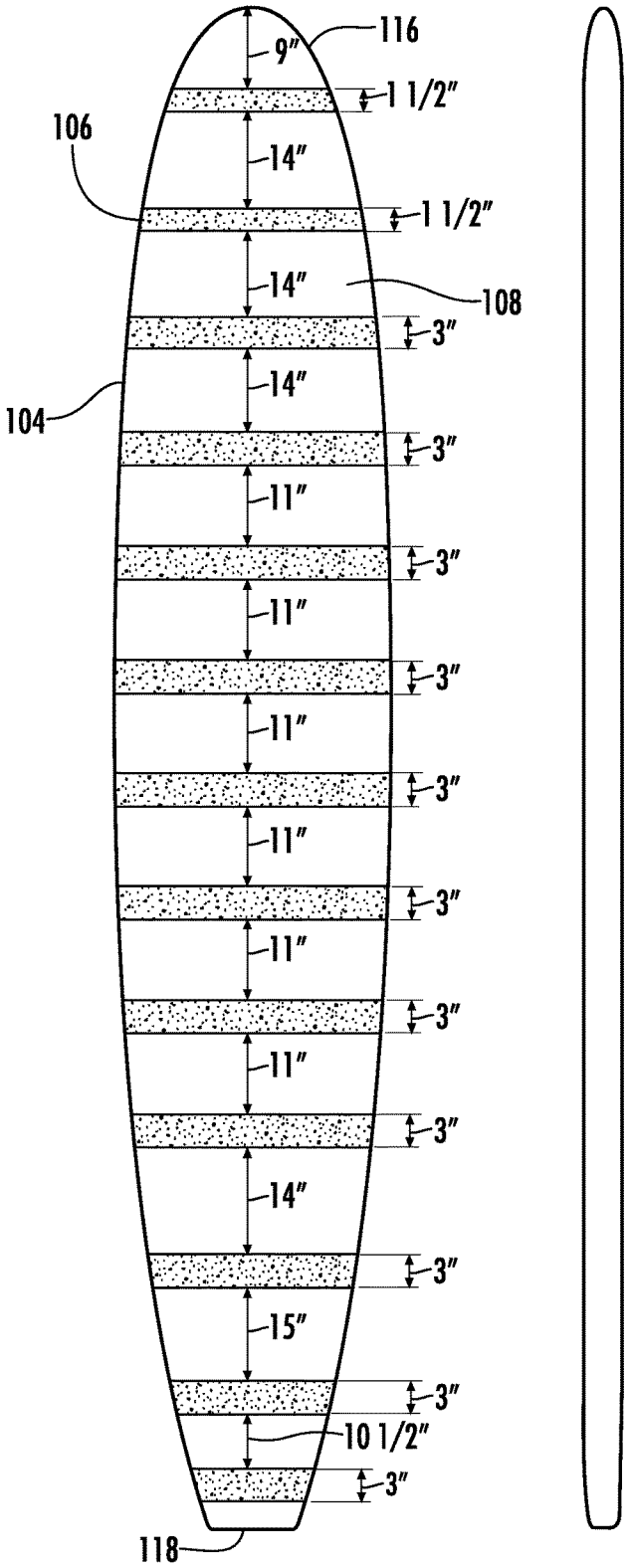
FIG. 1D is a schematic diagram illustrating an example SUP bottom portion showing the inner space and floatation slats.

The spacing of the slats 106 optionally varies as shown in FIG. 1D. For example, the slats may be separated by a smaller distance in the middle of the board, or under the deck region where the operator stands, as compared to the regions of the board between the deck region and the bow, or between the deck region and the stern. For example, the spacing between slats beneath the deck region is optionally eleven inches, with the slats being three inches wide in their width dimension. The spacing can increase between the slats beneath the region of board between the deck region and the bow end. For example, the spacing is optionally 14 inches in this area. The spacing can also increase between the slats beneath the region of board between the deck region and the stern end. For example, the spacing is optionally 15 inches in this area. All the slats can vary in width, and as a non-limiting example can be 3 inches. The width of the slats and the spacing of the slats beneath any region of the top surface 102 can be varied depending on factors such as how rigid the SUP is or how soft the top surface is in the deck region. For example, for heavier operators, wider slats under the deck region are optionally used. Moreover, for heavier operators, narrower spacing of the slats under the deck region is optionally used. With lighter users, the opposite is optionally the case; narrower and/or larger spacing of slats can be located under the deck region.

Figure 2A:
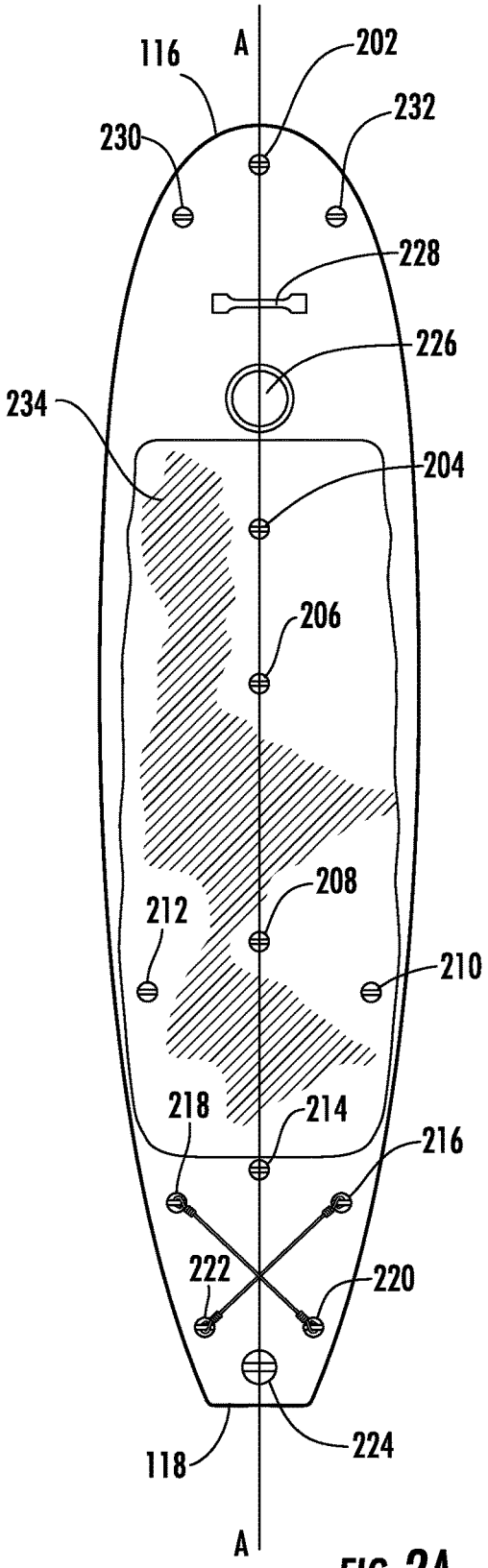
FIG. 2A is a schematic diagram illustrating a top surface of an example SUP.
Figure 8:
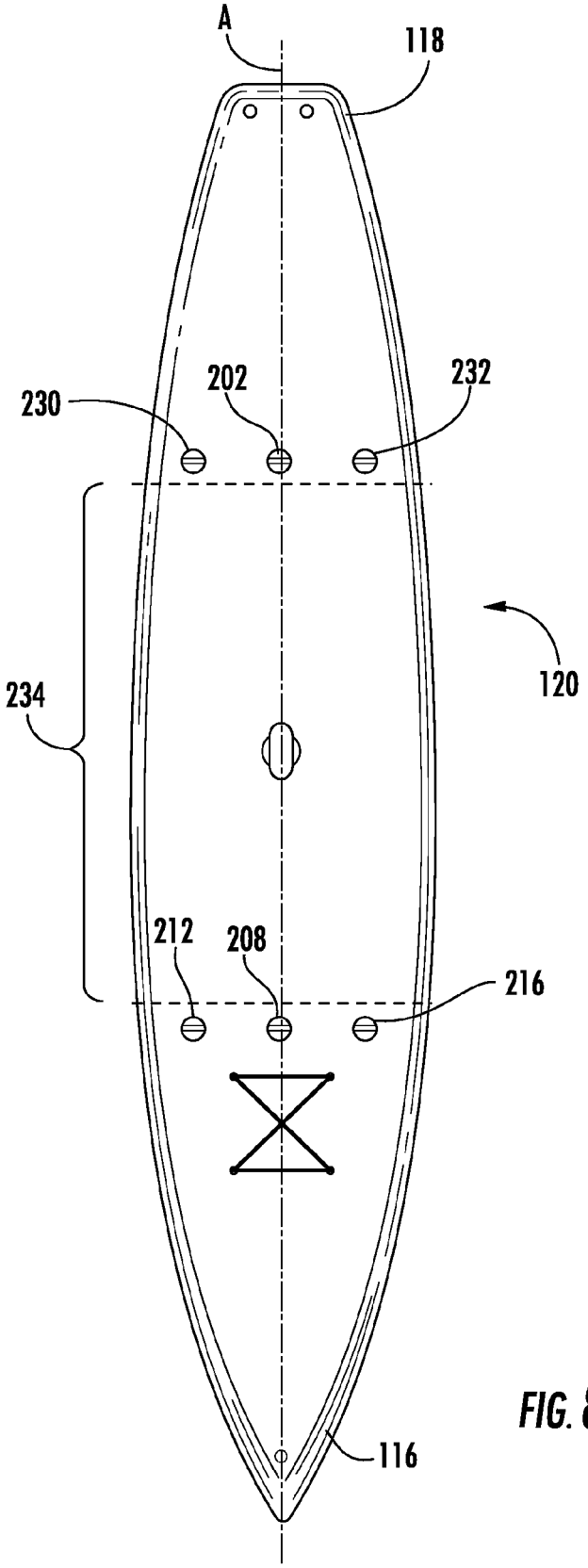
FIG. 8 is a schematic diagram illustrating a top surface of an example SUP.

Referring now to FIG. 2A and FIG. 8, example SUPs are schematically illustrated. The SUPs includes a deck region 234 where an operator is located while operating the SUP. The entire, or at least a substantial portion of, top surface 102 of the SUP optionally has a non-skid or non-slip surface that allows an operator to stand, kneel, sit or lay on the deck while reducing the likelihood of sliding off the board into the water. In one embodiment, for example as shown in FIG. 8, the non-skid or non-slip surface extends from the bow end to the stern end of the SUP, thereby substantially covering the top surface of the SUP. Alternatively, as shown in FIG. 2A only the deck region 234, where an operator is located while operating the SUP, or a portion thereof, has non-skid or non-slip properties. The deck region is optionally long enough for comfort in all Yoga and Pilates positions. The top surface, or alternatively just the deck region, is optionally made of ethylene vinyl acetate also known as EVA. EVA is a polymer that approaches elastomeric materials in softness and flexibility, yet can be processed like other thermoplastics. The material has good clarity and gloss, barrier properties, low-temperature toughness, stress-crack resistance, hot-melt adhesive water proof properties, and resistance to UV radiation.

The deck region is positioned between the bow end 116 and the stern end 118. Optionally, the deck region does not extend in the forward direction all the way to bow end, nor does it extend in the rear direction all the way to the stern end. In these examples, a region of non-deck, top surface exists between the forward end of the deck and the bow end and also between the rear end of the deck and the stern end.

The SUP has a long midline A-A. A plurality of attachment regions are optionally located along the midline. Each region of the plurality is located in a unique location along the axis such that the regions are spaced between the bow end to the stern end. Each attachment region includes an attachment member (202, 204, 206, 208 and 214). Each attachment region can be attached to an exercise device as described above. At least one attachment member 202 is located on the midline in front of the deck. At least one attachment member (204 and 208) is located on the midline in the deck region. At least one attachment member 214 is located behind the deck.

The SUP optionally includes one or more attachment member that is located off of the midline (230, 232, 212, 210, 218, 216, 222 and 220). The attachment members located off of the midline are optionally paired with another attachment member located off of the midline at a give distance between the bow end and stern end. For example, 230 and 232 optionally form a pair, 212 and 210 optionally form a pair, 218 and 216 optionally form a pair, and 222 and 220 optionally from a pair.

One or more of the off-midline attachment members are optionally located within the deck region. One or more of the off-midline attachment member are optionally located in front of the deck region. One or more of the off-midline attachment members are optionally located behind the deck region. One or more of the off-midline attachment members are optionally connected to an exercise device as described above.

In addition, one or more of the attachment members can be optionally attached to a bungee-cord which is optionally used to hold gear for the operator on the top surface of the board. For example, a bungee-cord can be positioned between attachment members 218, 216, 222 and 220. The bungee-cord can then be raised away from the top surface to allow placement of gear or other items under the cord which are then held on the top surface by force generated by the bungee-cord.

The attachment members that are connected to an exercise apparatus or device as described above can be located in attachment regions located on the top surface 102 of the SUP. These can be positioned to allow for the exercise of major muscle groups including, but not limited to, chest, back, biceps, triceps, shoulders and legs. The operator optionally grasps one or more elastic exercise tube that is attached to one or more attachment member. The attachment member that the elastic exercise tube is attached to and that which the operator grasps optionally varies. For example, these may vary depending on the muscle group to be exercised and/or on the position of the user on the SUP.

Figure 2B:
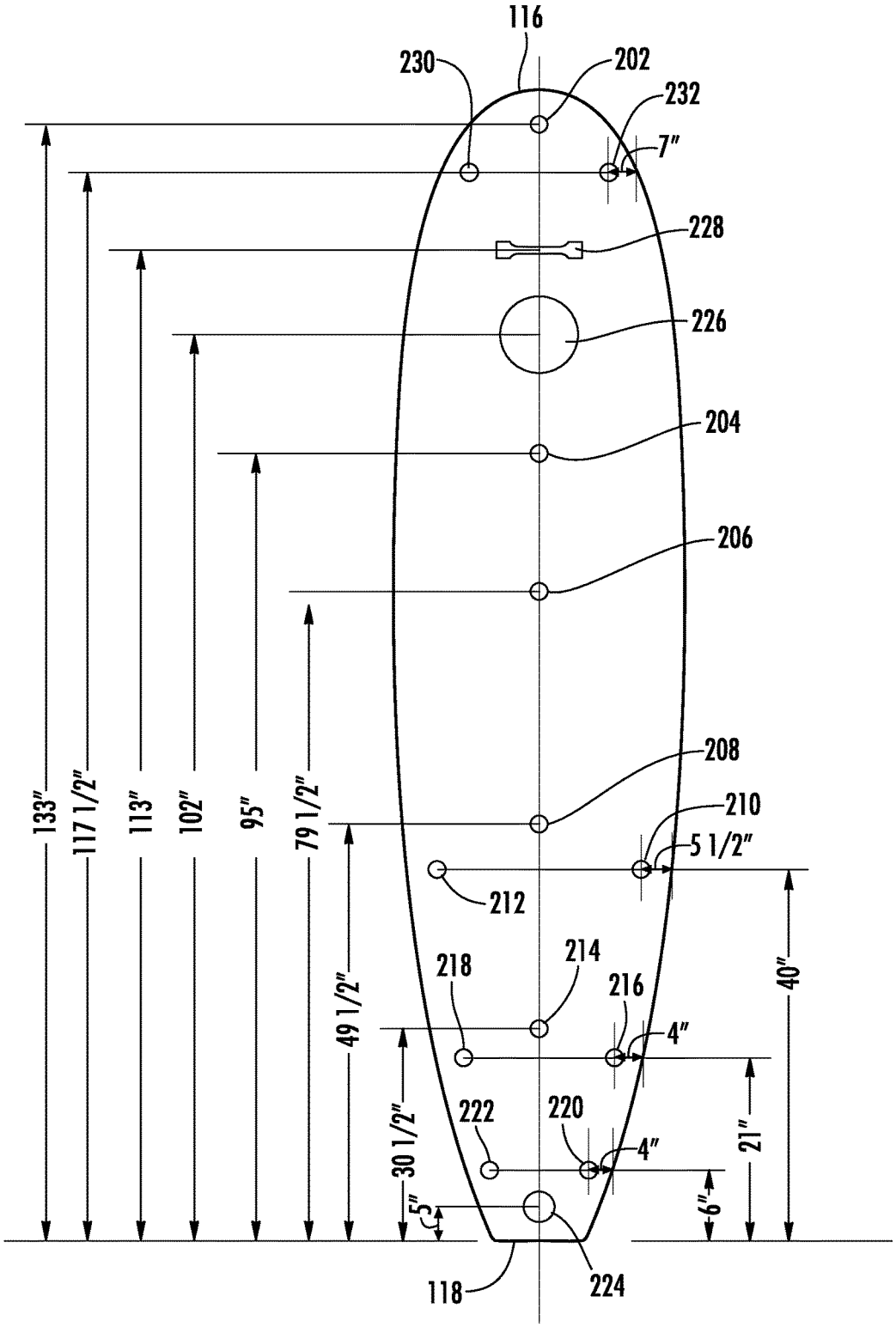
FIG. 2B is a schematic diagram illustrating a top surface of an example SUP.
Figure 7:
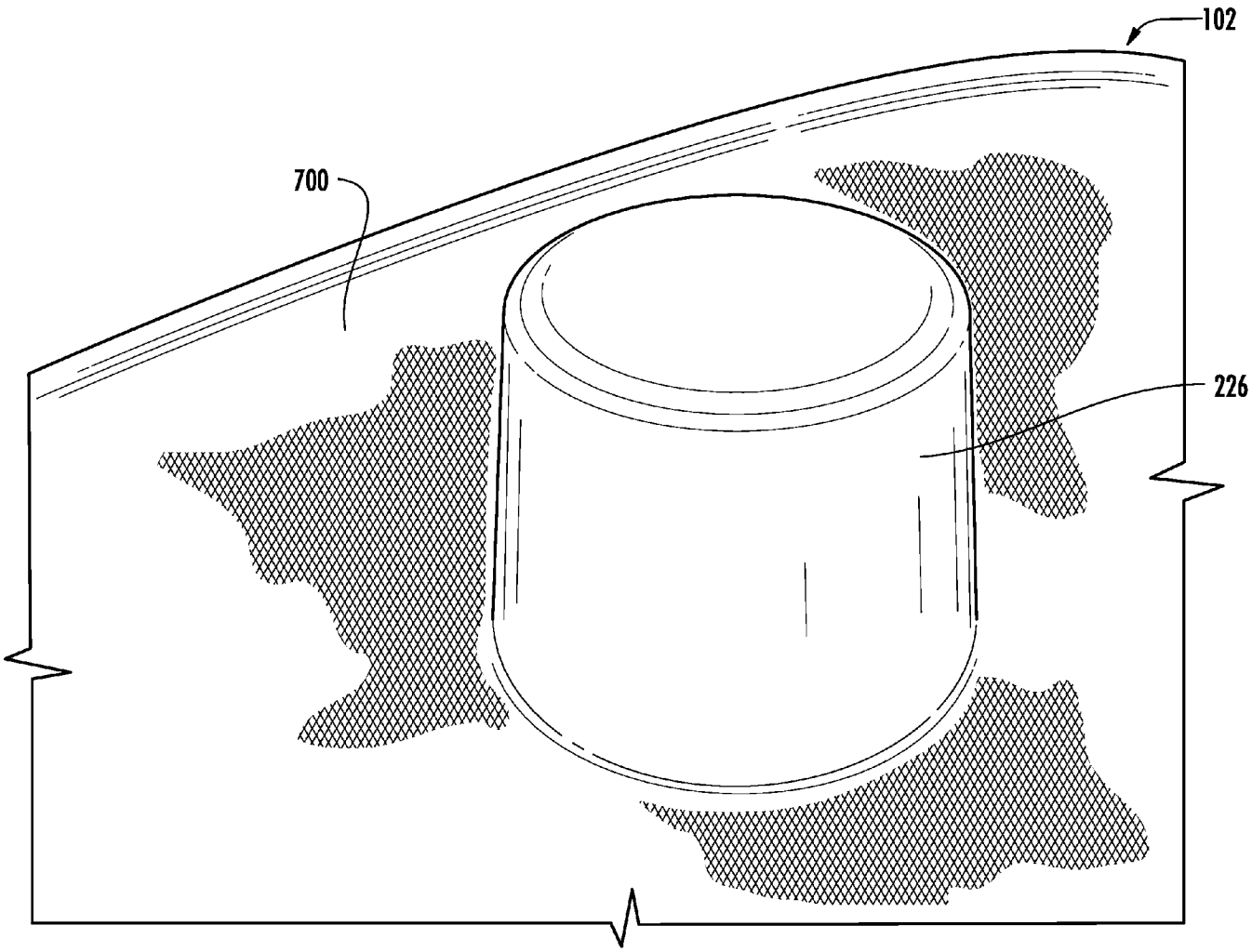
FIG. 7 is a schematic diagram illustrating the inside surface of the recess of a dry storage container.

The attachment members are optionally located at predetermined distances measured from certain features of the SUP, such as, for example, from the stern, from the midline, or form the rail edge. As also shown in FIGS. 2A and 2B, the SUP can further include a dry storage compartment 226 and a locking ring attachment 224. The dry storage compartment 226 is optionally used to keep its contents dry despite use of the SUP in a water environment. As shown in FIG. 7, the dry storage compartment 226 extends into the open space of the body as partially defined by an inner surface 700 of the top surface of the board. The locking ring attachment 224 can be used to secure the SUP to other structures, such as a dock or car. The locking ring attachment can also be used to attach other items other the SUP. Such items include any that a user of the SUP would want to be secured to the top of the board when in use, transport, or non-use of the board. The locking ring attachment 224 and the dry storage compartment 226 are described in further detail below.

Figure 3A:
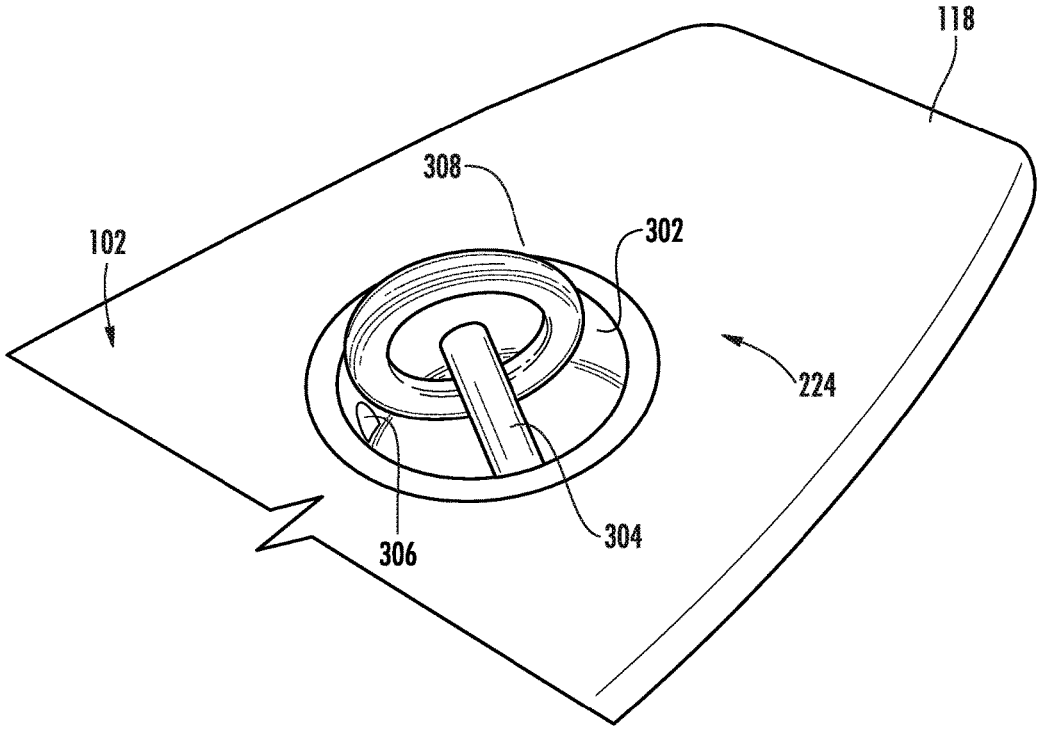
FIG. 3A is a schematic illustration of a portion of a top surface of an example SUP including an example locking ring mechanism.
Figure 3B:
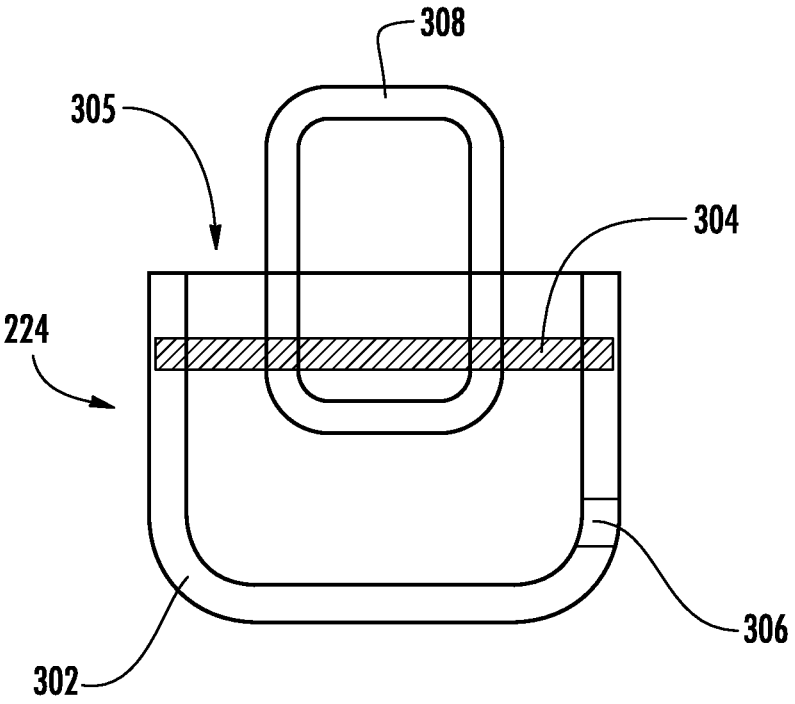
FIG. 3B is a schematic illustration showing a cross-section through a locking ring attachment.

FIGS. 3A and 3B schematically illustrate the locking ring attachment 224. It includes a PVC cup, or cavity, that protrudes from the top surface 102 into the open space of the body, optionally between two slats. The cup is sealed at the top surface to prevent ingress of water into the open space defined by the body. The opening of the cup is optionally flush with the top surface. The attachment 224 further includes a bar 304 that extends across the diameter of the cup. Optionally the bar is stainless steel. Optionally, the bar is 3/16 inch diameter stainless steel. A ring 308 is fitted over the bar 304. Optionally, the ring 308 is stainless steel. Optionally, the ring is 1/8 inch stainless steel. The bar is optionally located below the plane of the cup opening when not in use. The ring is optionally sized such that it can remain beneath the plane of the cup opening.

Figure 5:
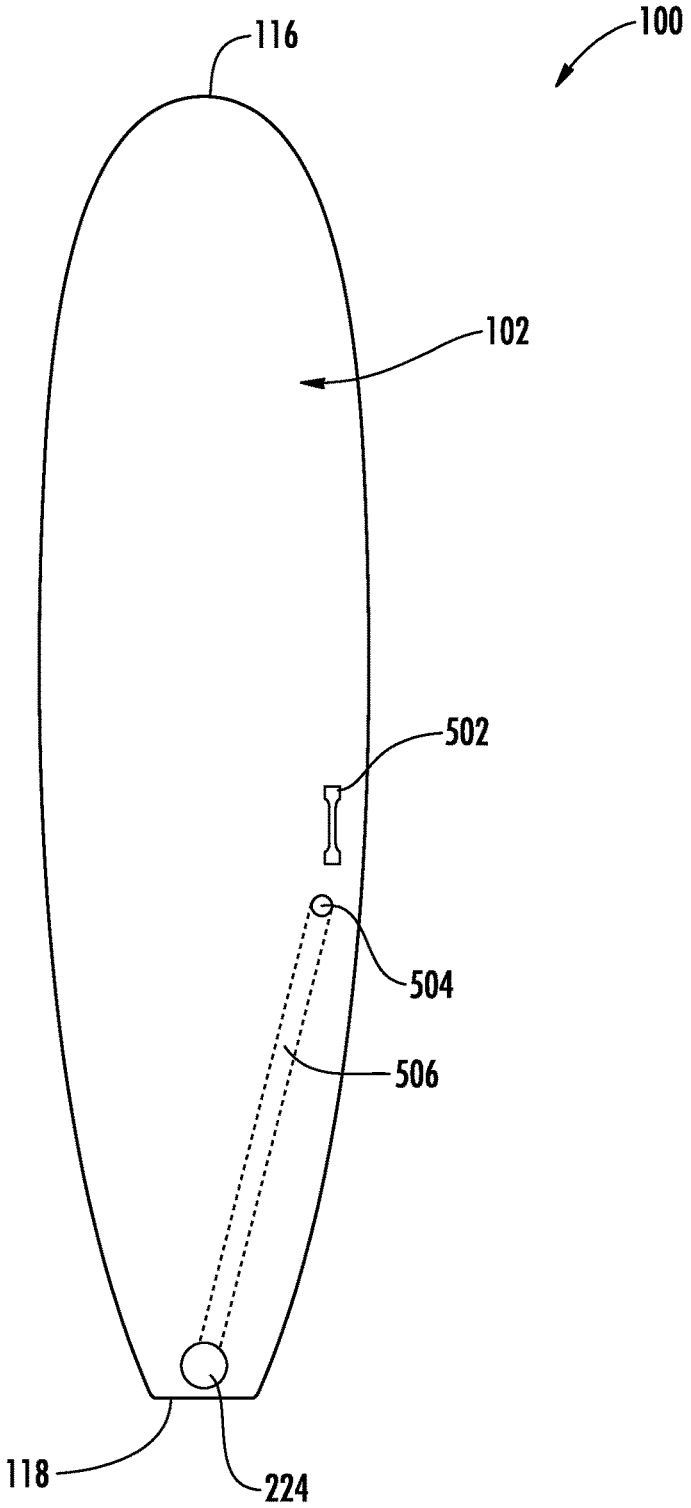
FIG. 5 is a schematic diagram illustrating portions of an anchor delivery mechanism.
Figure 6A:
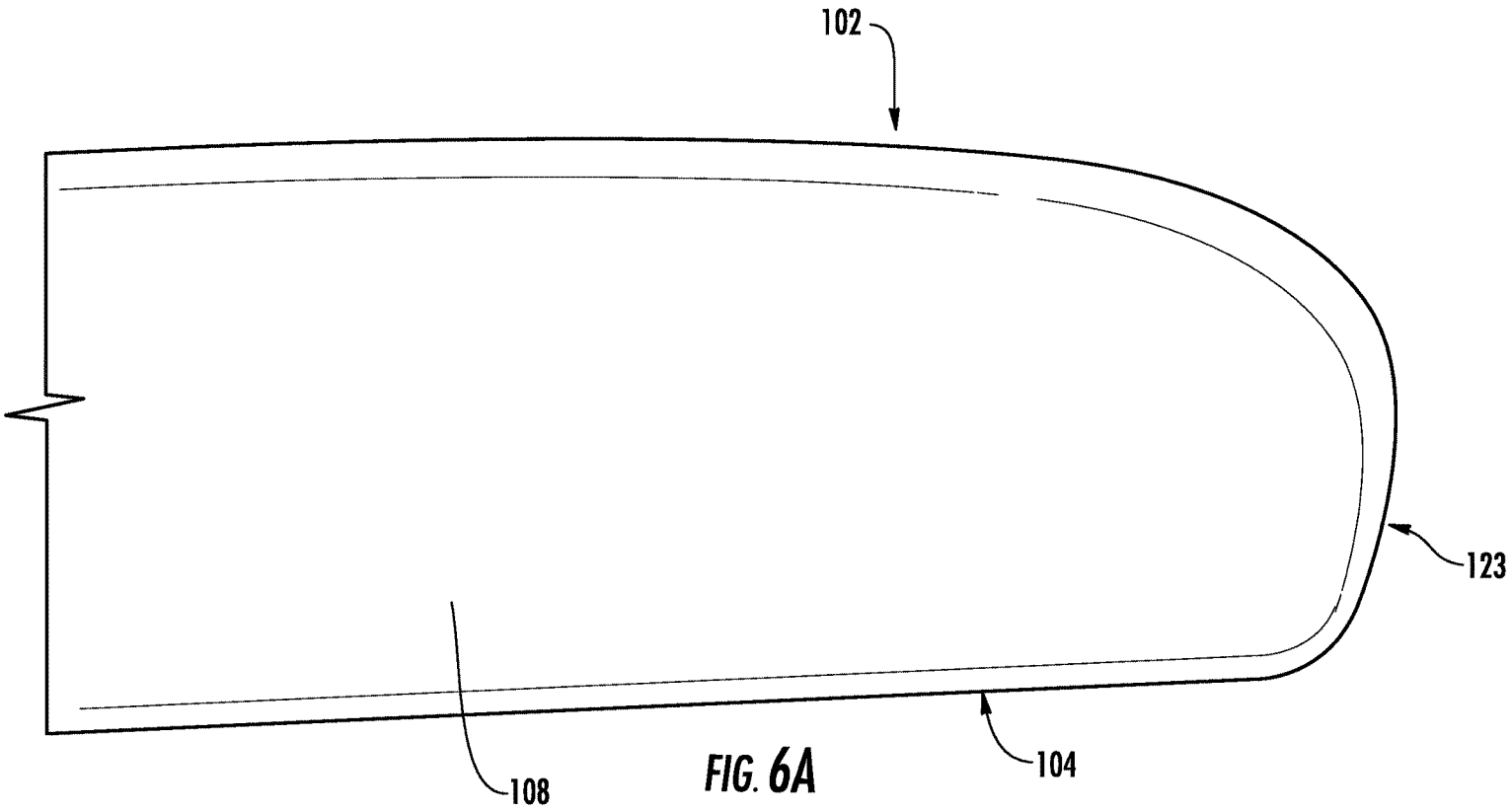
FIGS. 6A and 6B are schematic diagrams illustrating example SUP rails.
Figure 6B:
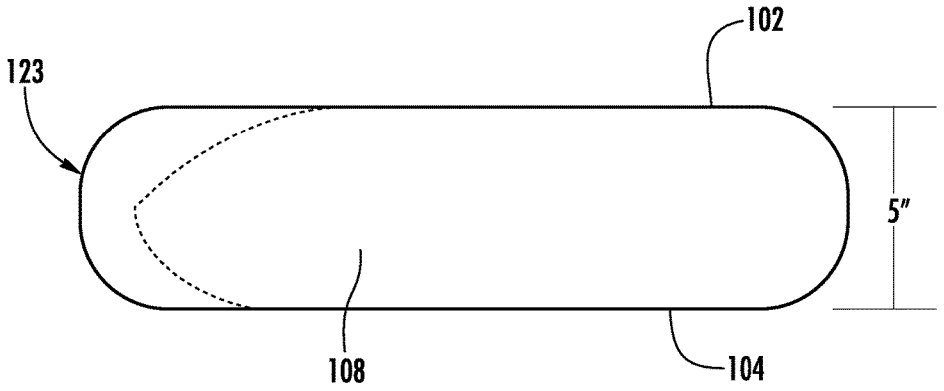

A rope, chain or other linking device can be attached to the ring 308, which can then be used to secure the SUP to the additional structure. An opening 306 is optionally located in the cup allowing the opening 306 to communicate with the opening of the cup itself. As described with regard to FIG. 5, the opening 306 is optionally sized to accommodate an anchor line so that the line can slide through the opening to allow an anchor to be lowered from the SUP to anchor the SUP while in use in the water. Thus, as shown in FIG. 5, the locking ring attachment 224 is optionally in communication with a channel 506 that is internal to the body of the SUP. For example, the channel 506 optionally terminates at the opening 306 such that an anchor line can slide within the channel, through the opening 306 and out into the water. At the opposite end of the channel 506 a second opening 504 allows the anchor line to exit the channel. The second opening 504 is optionally flush with the top surface 102. The anchor line extending out of the opening 504 can be secured to the top surface of the SUP. For example, the anchor line can optionally be releasably secured by a jam cleat 502.

The anchor system is manageable for the participants to quickly drop anchor for classes with the ability to easily pull the anchor at the end of the session to paddle back to shore. The design is tangle free with an interior track system, including the channel 506, which allows the user to easily move the anchor with no exterior ropes or pullies. The purpose of the anchor is optionally for Yoga and Pilates moves so that participants may hold their pose without having to worry about drifting away from the instructor and class.

Figure 4A:
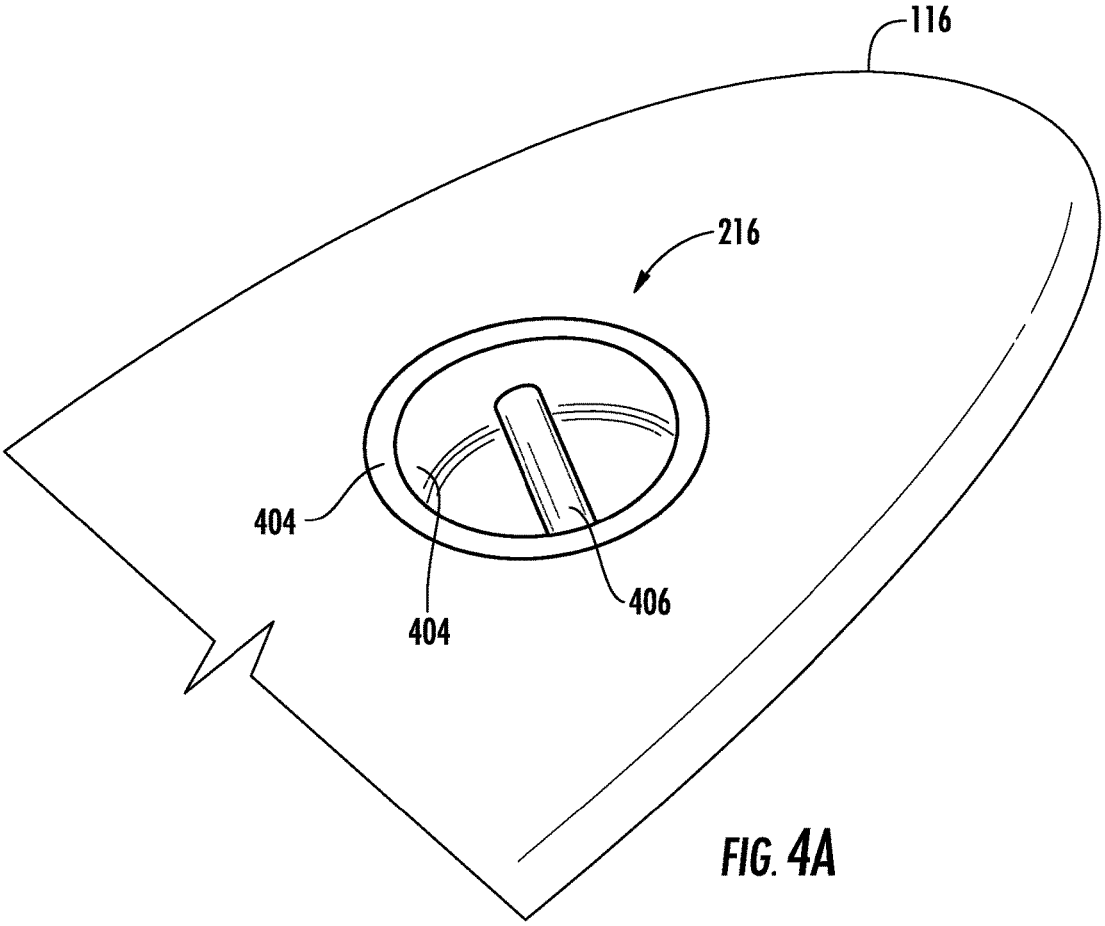
FIG. 4A is a schematic illustration of a portion of a top surface of an example SUP including an example attachment member.
Figure 4B:
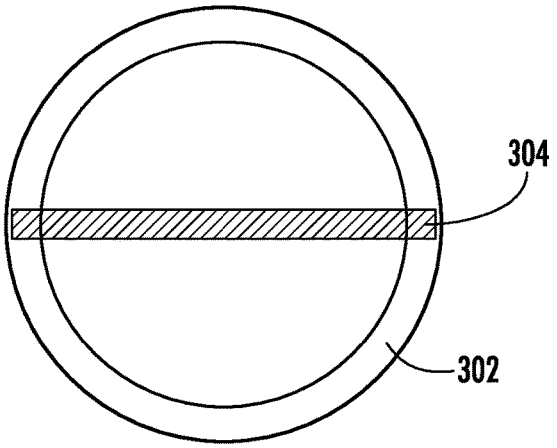
FIG. 4B is a schematic illustration of the example attachment member of FIG. 4A.

FIGS. 4A and 4B schematically illustrate an example attachment member 216, which is optionally identical or similar in structure to other attachment members. The attachment member 216 includes a PVC cup or cavity that protrudes from the top surface 102 into the open space of the body, optionally between two slats. The attachment members, such as an attachment member 216, can also be used in boards which are filled with foam or other buoyant materials. In this regard, the attachment members optionally include a cup or cavity that extends below the top surface level into the foam or buoyant material. The cup is sealed at the top surface to prevent ingress of water into the open space defined by the body, or into the foam or buoyant material. The opening of the cup is optionally flush with the top surface. The attachment member 216 further includes a bar 406 that extends across the diameter of the cup. Optionally the bar is stainless steel. Optionally, the bar is 3/16 inch diameter stainless steel. As described above, an exercise apparatus can be attached or connected with the attachment member 216. For example, as shown in FIGS. 1A and 1B, exercise tubing can be attached to the pin 406 thereby linking the exercise tubing to the SUP.

A number of embodiments of the invention have been described. Nevertheless, it will be understood that various modifications may be made without departing from the spirit and scope of the invention. Accordingly, other embodiments are within the scope of the following claims.

Disclosed are materials, systems, devices, compositions, and components that can be used for, can be used in conjunction with, can be used in preparation for, or are products of the disclosed methods, systems and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a method is disclosed and discussed each and every combination and permutation of the method, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A stand up paddleboard (SUP) exercise system, comprising:

a. a SUP, wherein the SUP comprises:

a floating body having a bow end, a stern end, a top surface and a bottom surface; and at least one attachment region located on the top surface, wherein at least one attachment member is located within the attachment region; and wherein the SUP exercise system further comprises:

b. an elastic exercise tubing or band connected to the attachment member; and c. a plurality of handles, each handle formed by a portion of the tubing or band, or attached to the elastic exercise tubing or band.

2. The SUP exercise system of claim 1, further comprising a deck region defined by a non-slip material on the top surface on which a user stands while operating the SUP.

3. The SUP exercise system of claim 2, wherein at least one attachment region is located within the deck region.

4. The SUP exercise system of claim 2, wherein at least one attachment region is located between the deck region and the bow end of the SUP.

5. The SUP exercise system of claim 2, wherein at least one attachment region is located between the deck region and the stern end of the SUP.

6. The system of claim 1, wherein the elastic exercise tubing or band is connected to the attachment member by a connector that is attached to the attachment member and to the elastic exercise tubing or band.

7. The system of claim 6, wherein the connector is a carabineer connector.

8. The system of claim 1, wherein the elastic exercise tubing or band has a resistance of at the most 14.2 pounds at 100 percent elongation.

9. A method of exercising on a stand up paddleboard (SUP), comprising:

a. standing, sitting or laying down on a SUP, wherein the SUP comprises a floating body having a bow end, a stern end, a top surface, a bottom surface and at least one attachment region located on the top surface, wherein at least one attachment member is located within the attachment region and wherein an elastic exercise tubing or band is connected to the attachment member; and b. grasping the elastic exercise tubing or band, or a handle attached to the elastic exercise tubing or band, and stretching the elastic exercise tubing or band to exercise one or more muscle groups while standing, sitting or laying down on the top surface of the floating SUP.

10. The method of claim 9, further comprising a deck region defined by a non-slip material on the top surface on which a user stands while operating the SUP.

11. The method of claim 10, wherein at least one attachment region is located within the deck region.

12. The method of claim 10, wherein at least one attachment region is located between the deck region and the bow end of the SUP.

13. The method of claim 10, wherein at least one attachment region is located between the deck region and the stern end of the SUP.

14. The method of claim 9, wherein the elastic exercise tubing or band is connected to the attachment member by a connector that is attached to the attachment member and to the elastic exercise tubing or band.

15. The method of claim 14, wherein the connector is a carabineer connector.

16. A stand up paddleboard (SUP) exercise system, comprising:

a. a SUP, wherein the SUP comprises:

a floating body having a bow end, a stern end, a top surface and a bottom surface; and at least one attachment region located on the top surface; wherein at least one attachment member is located within the attachment region; and wherein the SUP exercise system further comprises:

b. a plurality of elastic exercise tubings or bands, each tubing or band of the plurality of elastic exercise tubings or bands connected to an attachment member, and wherein each tubing or band of the plurality of elastic exercise tubings or bands comprises a portion that forms a handle or is attached to a handle.

17. The SUP exercise system of claim 16, wherein each elastic exercise tubing or band is connected to an attachment member by a connector that is attached to the attachment member and to the elastic exercise tubing or band.

18. The SUP exercise system of claim 17, wherein the connector is a carabineer connector.

19. The SUP exercise system of claim 16, wherein each elastic exercise tubing or band has a resistance of at the most 14.2 pounds at 100 percent elongation.

20. The SUP exercise system of claim 16, further comprising a deck region defined by a non-slip material on the top surface on which a user stands while operating the SUP.

21. The SUP exercise system of claim 20, wherein at least one attachment region is located within the deck region.

22. The SUP exercise system of claim 20, wherein at least one attachment region is located between the deck region and the bow end of the SUP.

23. The SUP exercise system of claim 20, wherein at least one attachment region is located between the deck region and the stern end of the SUP.

24. A stand up paddleboard (SUP) exercise system, comprising:

a. a SUP, wherein the SUP comprises:

a floating body having a bow end, a stern end, a top surface and a bottom surface; and at least one attachment region located on the top surface, wherein at least one attachment member is located within the attachment region; and wherein the SUP exercise system further comprises:

b. an elastic exercise tubing or band connected to the attachment member, the elastic exercise tubing or band having a resistance of at the most 14.2 pounds at 100 percent elongation.

25. The SUP exercise system of claim 24, wherein the elastic exercise tubing or band is connected to the attachment member by a connector that is attached to the attachment member and to the elastic exercise tubing or band.

26. The SUP exercise system of claim 25, wherein the connector is a carabineer connector.

* * * * *